US005296841A

United States Patent [19]

Vormbrock

[11] Patent Number: 5,296,841

[45] Date of Patent: Mar. 22, 1994

[54] CHAIN GUARD ALARM APPARATUS

[76] Inventor: Alan Vormbrock, 100 Schraalenburgh Rd., Harrington Park, N.J. 07640

[21] Appl. No.: 948,118

[22] Filed: Sep. 21, 1992

[51] Int. Cl.[5] ..... E05B 45/06; H01H 3/16

[52] U.S. Cl. ..... 340/542; 200/61.76

[58] Field of Search ..... 340/541, 542, 545, 548; 200/61.62, 61.76, 61.77, 61.93; 292/264

[56] References Cited

U.S. PATENT DOCUMENTS

| | | | |
|---|---|---|---|
| 3,406,386 | 10/1968 | Hawkins | 340/542 |
| 3,569,950 | 3/1971 | Betz | 340/542 |
| 3,585,625 | 6/1971 | Prinsky et al. | 340/542 |
| 3,705,421 | 12/1972 | Vanderveer | 340/542 |
| 3,714,644 | 1/1973 | Hellstrom | 340/542 X |
| 4,233,595 | 11/1980 | Landkammer | 340/542 |
| 4,495,486 | 1/1985 | White | 200/61.93 X |

FOREIGN PATENT DOCUMENTS

| | | | |
|---|---|---|---|
| 367268 | 1/1922 | Fed. Rep. of Germany | 340/542 |
| 621453 | 5/1927 | France | 340/542 |
| 68773 | 1/1945 | Norway | 340/542 |

*Primary Examiner*—John K. Peng
*Assistant Examiner*—Thomas J. Mullen, Jr.
*Attorney, Agent, or Firm*—Arthur I. Degenholtz

[57] ABSTRACT

An alarm includes a chain guard assembly in which a slide member is attached to a door jamb by a chain and is removeably engaged in a slot member which is mounted on the inside of a door. An alarm enclosure which is connected to the slot member includes an alarm and a battery. A normally open switch assembly is mounted on the slot member. Movement of the slide member caused by a forced opening of the door causes the slide member to bear against the switch assembly causing the switch assembly to close and complete an electrical circuit between the battery and the alarm thereby activating the alarm.

9 Claims, 2 Drawing Sheets

CHAIN GUARD ALARM APPARATUS

BACKGROUND OF THE INVENTION

With the increased awareness of a need for security against forced entry into various kinds of structures and especially dwellings, there has come a need for improved security equipment. While there have been numerous developments in the field of locks, deadbolts and mechanical means of preventing unwanted entry into a dwelling there has not been a corresponding development in the area of appropriate alarm systems. Most alarm systems require a permanent installation-which includes complex electrical wiring resulting in relatively high installation costs which makes them unsuitable for persons who are renting their dwelling units and who may not be able to afford the relatively high costs of a permanent installation. In addition, most persons who are renting their dwelling units are prevented from making extensive permanent modifications to their dwellings and are therefore unable to have the protection of an alarm system.

OBJECTS OF THE INVENTION

It is an objective of the present invention to provide a chain guard alarm apparatus which can easily be installed in a dwelling.

Another objective of the present invention is to provide a chain guard alarm apparatus which can be removed from a dwelling without leaving any damage.

Another objective of the present invention is to provide a chain guard alarm apparatus which does not require any external wiring or connection to a source of electrical power.

Another objective of the present invention is to provide a chain guard alarm apparatus which is activated immediately upon the forced entry through the door of a dwelling.

Another objective of the present invention is to provide a chain guard alarm apparatus which prevents forced entry through a door while simultaneously sounding an audible alarm.

Still another objective of the present invention is to provide a chain guard alarm apparatus which is composed of a relatively small number of component parts, each of which can be easily manufactured resulting in a relatively low overall cost.

SUMMARY OF THE INVENTION

In accordance with the present invention, there is provided a chain guard alarm apparatus which includes an alarm, a battery and a slot member which are mounted on the inside of the door of a dwelling. The slot member can removably accept a slide member which is attached to the door jamb by means of a flexible chain. The battery and the alarm are mounted in an enclosure. A normally open switch assembly is mounted on the slot member. Movement of the slide member caused by a forced opening of the door causes the slide member to bear against the switch assembly thereby closing the switch assembly and completing an electrical circuit between the battery and the alarm thereby activating the alarm.

BRIEF DESCRIPTION OF THE DRAWINGS

Additional objects and advantages of the invention and a fuller understanding of the invention may be had by referring to the following specifications and drawings in which.

DETAILED DESCRIPTION OF THE INVENTION

Figure 1:
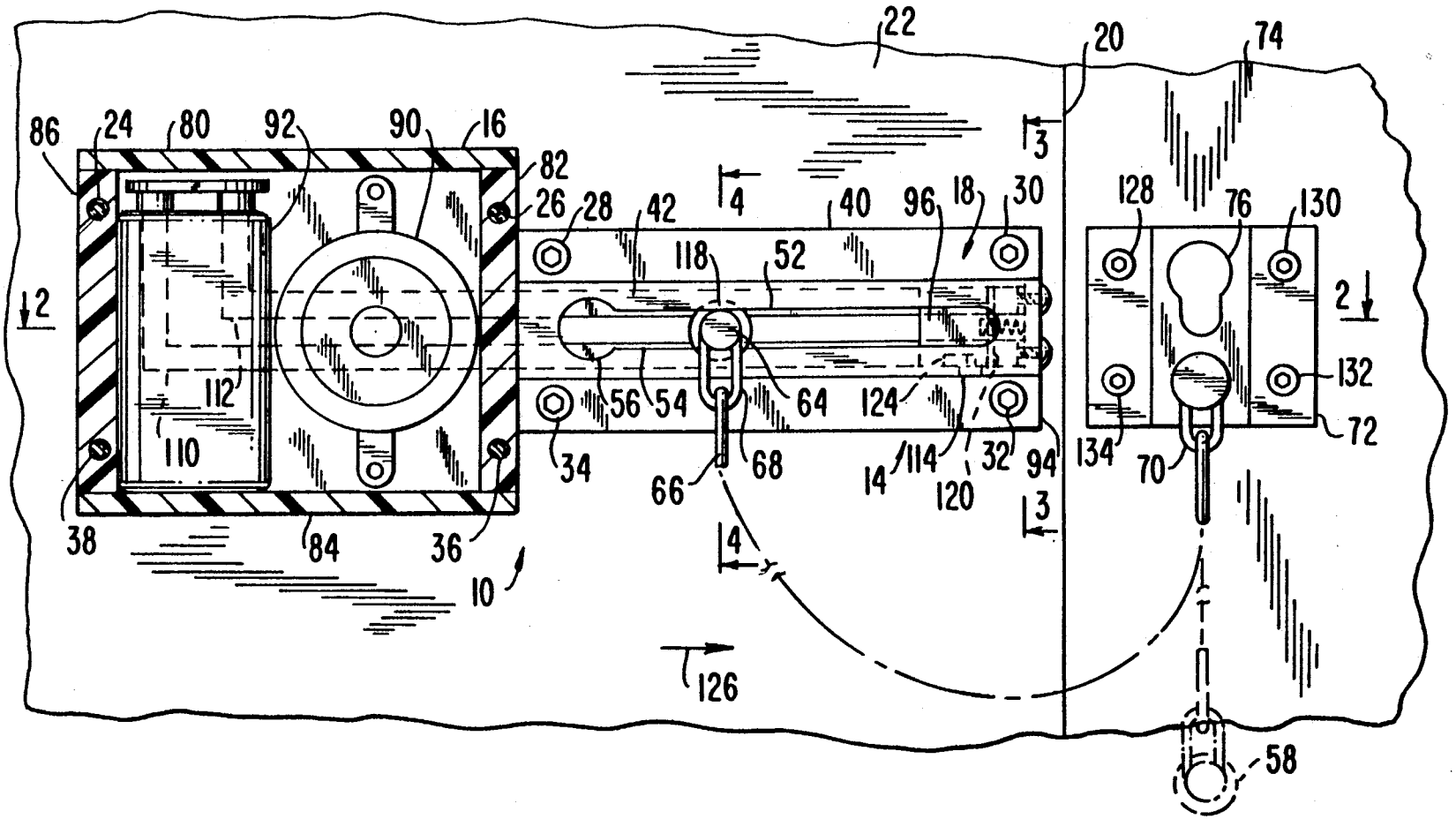
FIG. 1 is a front view of a chain guard alarm apparatus made in accordance with the present invention with the apparatus shown in use mounted on the door of a dwelling and with the apparatus shown partially in section to show details of internal construction.

With reference to the drawings there is shown in FIG. 1 a chain guard alarm apparatus 10 made according to the present invention which includes a base member 12, a chain guard assembly 14, an alarm enclosure 16 and a switch assembly 18.

Figure 2:
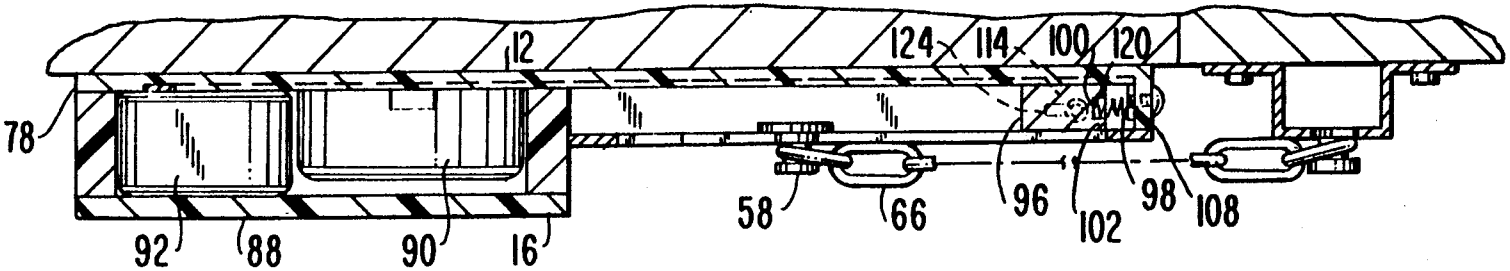
FIG. 2 is a cross-sectional view taken along the line 2—2 of FIG. 1.
Figure 4:
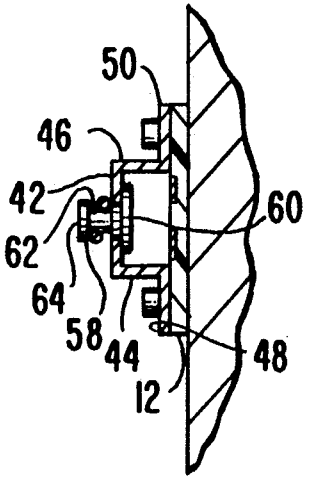
FIG. 4 is a cross-sectional view taken along the line 4—4 of FIG. 1.
Figure 3:
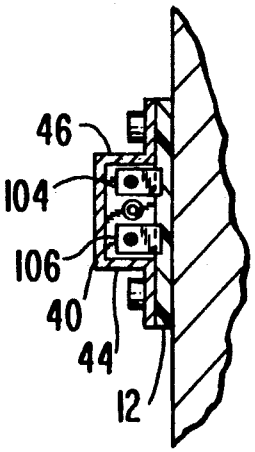
FIG. 3 is a cross-sectional view taken along the line 3—3 of FIG. 1.

The base member 12 is mounted adjacent to the edge 20 of a door 22 as is best shown in FIGS. 1 and 2 and is attached to the door 22 by means of screws 24,26,28,30,32,34 36,38. The chain guard assembly 14 includes a slot member 40 which has a generally hat shaped configuration when viewed in cross-section as in FIG. 4 and includes a central portion 42, a pair of support walls 44,46 which are connected to the central portion 42 and a pair of oppositely directed flange portions 48, 50 each connected to a support wall 44,46. Each of the flange portions 48,50 has a pair of holes through which a mounting screw 28,30,32,34 passes.

The central portion 42 includes a slot 52, the end 54 of which has an enlarged circular portion 56. This enlarged circular portion 56 is proportioned to accept the slider member 58 of the chain guard assembly 14. The slider member 58 of the chain guard assembly 14 has a lower circular portion 60, a central portion 62 which is proportioned to ride in the slot 52 and an upper circular portion 64 which rides above the slot 52 as best shown in FIG. 1. A flexible chain 66 is provided having a first end 68 attached to the slider member 58 and a second end 70 attached to a retainer member 72 which is mouted on the door jamb 74 of a dwelling by means of screws 128,130,132,134. The retainer member 72 has a keyhole shaped aperture 76 which is proportioned to accept and retain the slider member 58 when the apparatus 10 is not in use.

The left end 78 of the base member 12 supports the alarm enclosure 16 which includes wall portions 80,82,84,86 and a cover portion 88. The mounting screws 24,26,36,38 pass through the wall portions 82,86 and the cover portion 88. A battery operated alarm 90 and a battery 92 are mounted in the alarm enclosure 16 as is shown in FIGS. 1 and 2.

The switch assembly 18 is mounted on the right end 94 of the base member 12 and is positioned between the support walls 44,46 of the slot member 40. The switch assembly 18 includes a non-metallic switch block 96 which is slideably mounted between the support walls 44,46. A helical compression spring 98 is retained within a cavity 100 formed on the surface 102 of the switch block 96. The spring 98 biases the switch block 96 away from the electrical contacts 104,106 which are mounted in the end plate 108. A metal plate 120 is mounted on the surface 102 of the switch block 96.

A guide pin 114 is mounted on a wall 44 of the slot member 40 and projects into a groove 124 which is formed in the switch block 96. The guide pin 114 and the groove 124 limit the range of motion of the switch block 96 relative to the slot member 40.

The electrical contacts 104,106 are connected to the battery 92 by electrical connections which are conventional and may be in the nature of plated printed circuit conductor strips 110,112 or conventional wires. The battery 92 is similarly connected to the alarm 90 by conventional electrical connections which are not shown. The alarm 90 is normally off and is operated only when electrical contact is made between the electrical contacts 104,106 in a manner which will be presently described.

During normal use, the door 22 is closed and the slide member 58 is engaged in the slot 52 as is shown in FIG. 1. The slide member 52 is normally disposed in an intermediate portion 118 of the slot 152 as is shown in FIG. 1 and the spring 98 biases the switch block 96 away from the electrical contacts 104,106.

In the event of an attempt at a forced entry through the door 22 the slide member 58 is pulled quickly toward the right as is shown by the arrow 126 in FIG. 1 and the lower circular portion 60 of the slide member 58 contacts the switch block 96 and forces the switch block 96 into contact with the electrical contacts 104,106. The switch block 96 thus completes the electrical circuit between the electrical contacts 104,106 and the alarm 90 is activated. The alarm 90 continues to be activated as long as the intruder continues to attempt to force the door 22 to open. The immediate activation of the alarm 90 with the attempt to open the door 22 causes the intruder to abandon the attempt at entry.

The chain guard alarm apparatus 10 thus provides the security of a chain guard 14 in which the slider 58 is retained in the slot 52 preventing the door 22 from being opened with the additional protection of the alarm 90 which is activated the instant that the door 22 is forced open. The activation of the alarm 90 causes the intruder to stop trying to overcome the locking effect of the chain guard assembly 14 and to abandon the attempt at forced entry.

When desired, the chain guard alarm apparatus 10 may be easily removed from the door 22 and the door jamb 74 by removing the screws 24,26,28,30,32,34,36,38,128,130,132 and 134.

In an alternative embodiment of the invention which is not shown the switch assembly 18 is replaced by a normally off microswitch which is located on the right end 94 of the base member 12. When there is an attempt at forced entry the slider contacts the microswitch, turning the microswitch on, thereby activating the alarm 90 in the manner which has been previously described.

While preferred embodiments of the invention have been shown and described herein, it is obvious that numerous additions, changes and omissions may be made in such embodiments without departing from the spirit and scope of the invention.

What is claimed is:

1. A chain guard alarm apparatus comprising a slot member having a slot portion and a pair of side panels, mounting means disposed on said slot member for mounting said slot member on a door, a slide member removeably engaged in said slot portion, a retainer member, mounting means disposed on said retainer member for mounting said retainer member on a door jamb, flexible chain means connecting said retainer member and said slide member, electrically operated alarm means mounted on said slot member, battery means mounted on said slot member, normally open switch means mounted on said slot member with said switch means being closed when said slide member is engaged in said slot portion and said door is opened, electrical connection means connecting said switch means, said battery means and said alarm means for activation of said alarm means responsive to said slide member closing said switch means as a result of said door being opened, with said switch means comprising a slide block with said slide block slideably disposed between said side panels of said slot member, a conductive plate mounted on said slide member, a pair of electrical contacts mounted on said slot member, and helical spring means mounted on said slide block and disposed to bias said slide block away from said electrical contacts until pressure applied to said slide block overcomes the bias of said helical spring means and brings said plate into contact with said electrical contacts thereby completing an electric circuit between said electrical contacts.

2. A chain guard alarm apparatus according to claim 1 in which said alarm means comprises audible alarm means.

3. A chain guard alarm apparatus according to claim 1 in which said slot member comprises a first panel portion having a pair of relatively longer edges and a pair of relatively shorter edges, wherein said pair of side panels each projects generally perpendicularly from a respective one of said relatively longer edges of said first panel portion, and a pair of flange members with said flange members each projecting generally perpendicularly from a respective one of said side panels.

4. A chain guard alarm apparatus according to claim 1 in which said switch means are mounted proximate to an end of said slot portion.

5. A chain guard alarm apparatus according to claim 1 in which said switch means are mounted between said side panels of said slot member.

6. A chain guard alarm apparatus according to claim 1 in which said electrical connection means comprises printed circuit conductor means.

7. A chain guard alarm apparatus according to claim 1 further comprising enclosure means connected to said slot member with said battery means and said alarm means mounted in said enclosure means.

8. A chain guard alarm apparatus according to claim 7 further comprising a base member with said slot member and said enclosure means mounted on said base member.

9. A chain guard alarm apparatus according to claim 1 in which each of said mounting means comprises a plurality of mounting screws.

* * * * *